US011105324B2

(12) United States Patent
Meid et al.

(10) Patent No.: US 11,105,324 B2
(45) Date of Patent: Aug. 31, 2021

(54) HYDRAULIC ARRANGEMENT

(71) Applicant: DEERE & COMPANY, Moline, IL (US)

(72) Inventors: Michael Meid, Waghaeusel (DE); Manuel Billich, Dischingen (DE)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/038,161

(22) Filed: Sep. 30, 2020

(65) Prior Publication Data

US 2021/0115649 A1 Apr. 22, 2021

(30) Foreign Application Priority Data

Oct. 17, 2019 (DE) ..... 102019215975.3

(51) Int. Cl.

| | |
|---|---|
| ***F04B 23/02*** | (2006.01) |
| ***E02F 9/22*** | (2006.01) |
| ***F04B 23/04*** | (2006.01) |
| ***F04B 53/20*** | (2006.01) |

(52) U.S. Cl.

CPC ..... *F04B 23/021* (2013.01); *E02F 9/2221* (2013.01); *E02F 9/2292* (2013.01); *F04B 23/04* (2013.01); *F04B 53/20* (2013.01)

(58) Field of Classification Search

CPC .. F15B 21/041; F15B 21/0427; F15B 21/047; F04B 23/021; F04B 23/025; F04B 23/04; F04B 49/06; F04B 49/065; F04B 53/20

See application file for complete search history.

(56) References Cited

U.S. PATENT DOCUMENTS

| | | | | |
|---|---|---|---|---|
| 7,444,809 | B2 * | 11/2008 | Smith | E02F 9/2292 60/413 |
| 7,845,914 | B2 | 12/2010 | Engelbrecht et al. | |
| 9,982,669 | B2 * | 5/2018 | Desiderio | F04B 19/22 |
| 10,631,531 | B2 | 4/2020 | Engelbrecht et al. | |
| 10,655,649 | B2 * | 5/2020 | Diges | F04B 23/02 |
| 2005/0175467 | A1 * | 8/2005 | Yogo | F04B 23/021 417/217 |

FOREIGN PATENT DOCUMENTS

| | | | |
|---|---|---|---|
| DE | 3839689 | A1 | 5/1990 |
| DE | 3931699 | A1 | 2/1991 |
| DE | 10215068 | A1 | 10/2003 |
| WO | WO2018162187 | A1 | 9/2018 |
| WO | WO2019081159 | A1 | 5/2019 |

OTHER PUBLICATIONS

European Search Report issued in counterpart application No. 20197627.1 dated Apr. 1, 2021 (03 pages).

* cited by examiner

*Primary Examiner* — Michael Leslie

(57) ABSTRACT

A hydraulic arrangement includes a working pump for conveying a hydraulic medium in a direction of a hydraulic working load, a hydraulic tank comprising a tank outlet hydraulically connected to an inlet side of the working pump, and an auxiliary pump mounted in the hydraulic tank. A hydraulic flow of the hydraulic medium flows in the direction of the tank outlet in dependence on a control system.

22 Claims, 1 Drawing Sheet

HYDRAULIC ARRANGEMENT

RELATED APPLICATIONS

This application claims priority to German Application No. 102019215975.3, filed Oct. 17, 2019, the disclosure of which is hereby expressly incorporated by reference in its entirety.

FIELD OF THE DISCLOSURE

The present disclosure relates to a hydraulic arrangement including a working pump for conveying a hydraulic medium in the direction of a hydraulic working load.

BACKGROUND

In the case of a conventional hydraulic arrangement, a suction strainer is often hydraulically connected to the working pump on the inlet side in order to keep unwanted particles away from the working pump and from the hydraulic lines connected to the working pump. The suction strainer can create a pressure drop which, under certain circumstances, affects the suction pressure on the inlet side of the working pump.

Thus, there is a need to improve the operating behavior of the working pump of a hydraulic arrangement in a technically simple manner.

SUMMARY

In the present disclosure, the hydraulic arrangement comprises a working pump for conveying a hydraulic medium (e.g., oil) in the direction of a hydraulic working load, which acts as a hydraulic consumer. The hydraulic arrangement additionally comprises a hydraulic tank and an auxiliary pump. The hydraulic tank has a tank outlet for a hydraulic connection of the inlet side of the working pump, such that the working pump is hydraulically connected to the hydraulic tank on the inlet side. The auxiliary pump is mounted in the hydraulic tank, and causes a hydraulic flow in the direction of the tank outlet in dependence on a control system (e.g., an associated electric drive).

The auxiliary pump can be activated according to a requirement by the control system. The auxiliary pump can therefore, for example, compensate an unwanted pressure drop on the inlet side of the working pump by actively pumping hydraulic medium in the direction of the tank outlet when a corresponding pressure drop is detected at the working pump. In addition, the auxiliary pump can actively support the working pump, in the manner of a charging function, when the latter, in the cold-start phase, sucks in the hydraulic medium that is not yet warm from operation. The auxiliary pump can thus be used selectively to avoid any excessively low suction pressures at the inlet of the working pump. This in turn allows the hydraulic connection of suction strainers, even with particularly fine-meshed strainer meshes, at the inlet side of the working pump without the risk of excessively low suction pressures. Overall, the auxiliary pump is a technically simple way of ensuring that, on the one hand, unwanted particles and other foreign bodies are reliably kept away from the working pump and, on the other hand, excessively low suction pressures are reliably avoided.

The working pump may be, for example, a self-priming pump. In particular, the working pump may be an axial piston pump, vane pump or gear pump.

The control of the operation of the auxiliary pump is effected in dependence on at least one sensed physical quantity of the working pump or of the hydraulic medium or of the auxiliary pump or of a vehicle system or of the environment. This control enables the auxiliary pump to be operated according to a requirement, thereby enabling the latter to be operated very efficiently and in an energy-saving manner within the hydraulic system.

The following quantities, for example, constitute possible physical quantities:

i) an inlet-side suction pressure of the working pump;

ii) a quantity that represents a state or technical quality of the hydraulic medium (e.g., temperature, flow behavior, volume flow, flowing hydraulic quantity);

iii) an electric pump current of an electric drive of the auxiliary pump; or iv) a quantity representing a coolant temperature of a vehicle drive system or an ambient temperature.

The physical quantities are sensed or determined, in particular, by suitable sensor technology. The sensor signals may be processed in a suitable control unit, e.g., compared with predefined threshold values. Control signals, for controlling the electric drive of the auxiliary pump, may be derived from the processing or comparison result. Moreover, individual sensor signals may be used to transmit information regarding a necessary oil change to an indicator unit (e.g., optical or acoustic) controlled by the control unit. This allows service and maintenance intervals to be individually adapted to the actual operating state of the hydraulic system. The maintenance work of the hydraulic system can thus be performed more efficiently and cost-effectively.

In addition, sensing or measurement of the pump current of an electrically driven auxiliary pump may be used to indirectly determine the degree of loading of a filter unit that is hydraulically connected to the auxiliary pump on the outlet side, and through which the hydraulic medium flows. Depending on the determined values of the pump current, it is in turn possible to signal, via the already mentioned control unit and via the indicator unit controlled by it, that replacement of this filter unit is necessary.

Energy-saving operation of the auxiliary pump is further supported by the fact that it is driven by an electric motor. This electric motor, in turn, can if necessary be controlled in a very precise and efficient manner by the control unit explained above. In addition, the electric pump drive can be installed in a very space-saving manner within the hydraulic arrangement, in particular within the hydraulic tank, thus supporting a compact design of the arrangement as a whole.

In one embodiment, a conveying channel, through which the hydraulic medium can flow, is hydraulically interposed between the tank outlet and a pump outlet of the auxiliary pump. The auxiliary pump, in its activated state, thus pumps hydraulic medium through the conveying channel. Depending on the technical design, the conveying channel may serve to influence the hydraulic medium flowing through it in such a manner that the operating behavior of the working pump is supported.

In particular, the conveying channel is arranged at least partially, or completely, within the hydraulic tank. This facilitates a compact, space-saving design of the hydraulic arrangement. Its installation in an agricultural utility vehicle or other mobile hydraulic application allows correspondingly easier mounting, and is less expensive.

In another embodiment, the conveying channel has a heat exchanger through which hydraulic medium can flow. In particular, the heat exchanger is liquid-cooled, and a corresponding coolant flows through it on the secondary side.

Depending on the temperature conditions between the heat exchanger, or its coolant, on the one hand, and the hydraulic medium, on the other hand, the heat exchanger can be used to heat or cool the hydraulic medium. The heat exchanger thereby contributes to a further improved operating behavior of the working pump.

The conveying channel has a filter unit through which hydraulic medium can flow to filter out unwanted particles and other foreign bodies that impair the hydraulic medium and thus also the hydraulic circuit. In this case, the filter unit is constituted by a bypass filter. The filter unit is realized, in particular, as a fine filter (e.g., filter element made of cellulose, microfiber) having a particularly fine-meshed filter surface. This enables a correspondingly coarser-meshed dimensioning of a return filter, which in the hydraulic circuit is integrated, after the hydraulic working load, into the return side of the hydraulic arrangement. The coarser-meshed dimensioning reliably avoids any unwanted pressure losses of the hydraulic arrangement in the region of the return filter, thereby further improving the efficiency and the hydraulic operating behavior of the hydraulic arrangement.

In a further embodiment, the conveying channel has a suction strainer. Owing to the technical effect and advantages of the auxiliary pump already described, even in terms of efficient filtering, a relatively fine-meshed suction strainer, e.g., a wire mesh, cannot impair the desired suction pressure at the working pump.

For a particularly efficient effect of the suction strainer, it is arranged along the direction of flow in the hydraulic tank, in particular directly before the tank outlet where it is hydraulically connected to the tank outlet.

In a further embodiment, the hydraulic arrangement is used in mobile hydraulics, e.g., in agricultural utility vehicles (in particular towing vehicles, tractors), construction machinery or road construction vehicles. Accordingly, the hydraulic working load is included in one of the aforementioned mobile machines, or vehicles. The hydraulic working load may be realized, for example, as a steering or braking unit, hydraulic motor or power-lift cylinder.

In a utility vehicle, the hydraulic arrangement, or the hydraulic circuit containing it, may be operated as a hydraulic circuit that is separate from the vehicle transmission. In this way, the transmission hydraulics can be reliably protected against any contamination by the working load hydraulics.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawing, wherein.

Corresponding reference numerals are used to indicate corresponding parts in the drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
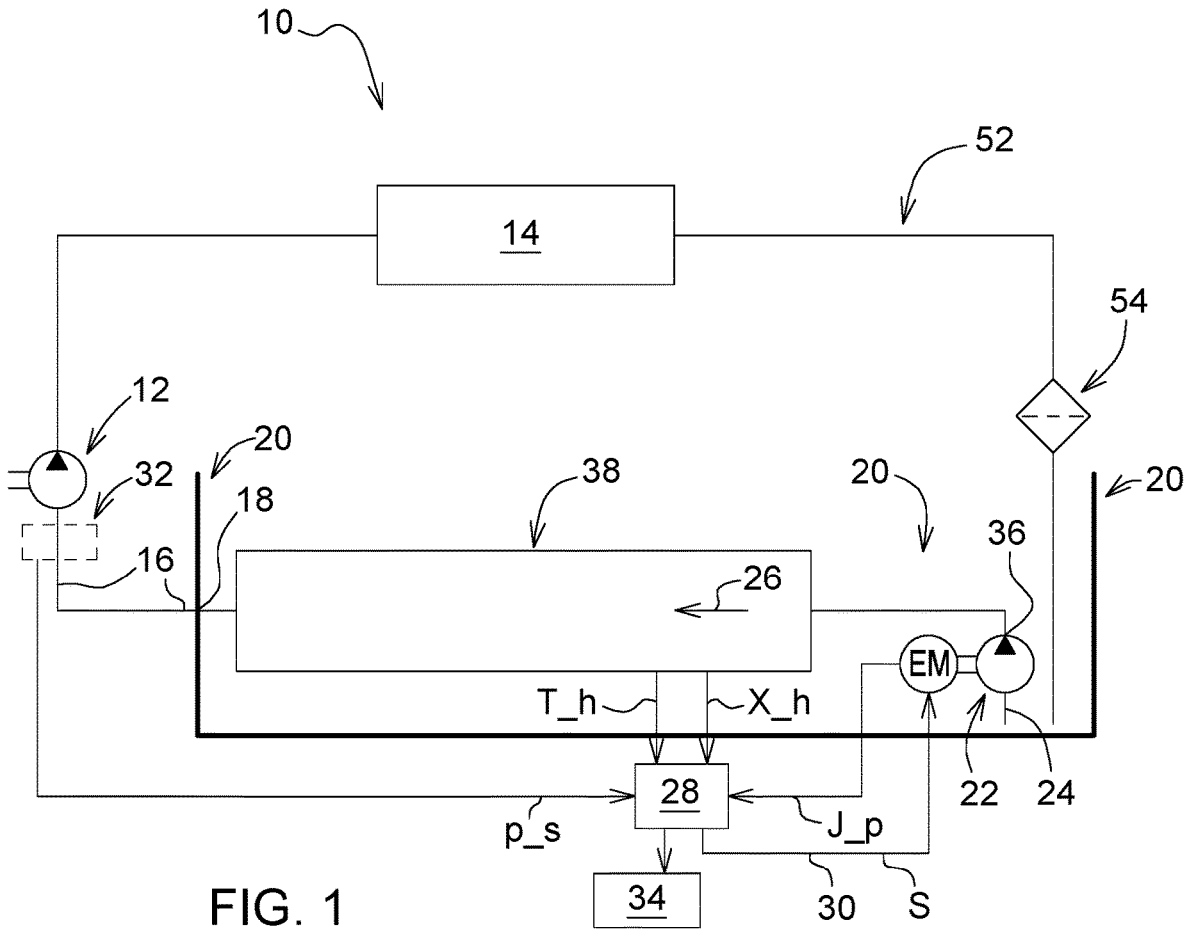
FIG. 1 is a schematic representation of the hydraulic arrangement according to the present disclosure.

FIG. 1 shows a hydraulic arrangement 10, or a hydraulic circuit, comprising a working pump 12 for conveying a hydraulic medium (e.g., oil) in the direction of a hydraulic working load 14. The latter is represented merely in the manner of a schematic block diagram, and in respect of its number and its function represents differing possible hydraulic consumers, for example a braking or steering unit, or a power-lift cylinder. The working pump 12 is hydraulically connected, by a suction line 16, to a tank outlet 18 of a hydraulic tank 20, or sump, containing the hydraulic medium. The drive of the working pump 12 may be derived from a vehicle drive system in the form of a drive motor in the usual way, which is not represented in greater detail here.

The hydraulic arrangement 10, located in an agricultural utility vehicle (not shown) also has an auxiliary pump 22 that can be driven electrically by an electric motor EM. It is located, with an intake line 24, in the hydraulic tank 20. The auxiliary pump 22 can be activated according to requirement, and can then cause a hydraulic flow 26 in the direction of the tank outlet 18. Activation of the auxiliary pump 22 according to requirement is effected by a control unit 28 that controls the electric motor EM. For this purpose, the control unit 28 is connected to the electric motor EM via a control line 30. The corresponding control signals S are generated by the control unit 28 in dependence on the sensing and processing of at least one specific physical quantity. In the exemplary embodiment according to FIG. 1, a plurality of physical quantities are provided. A pressure sensor 32 senses an inlet-side suction pressure p_s at the working pump 12. In addition, a pump current I_p of the electric motor EM is measured, and the measured values are transmitted to the control unit 28. A current temperature T_h of the hydraulic medium is also sensed. At least one further quantity X_h (e.g., flow behavior, oil quality) representing the state of the hydraulic medium is sensed and transmitted to the control unit 28. In addition, the control unit receives further sensor data from a communication bus system of the vehicle, such as, for example, a coolant temperature T_k of the vehicle drive system, and an ambient temperature T_u. From the data of the sensed physical quantities, the control unit 28 determines whether, and for how long, the auxiliary pump 22 must be activated, and sends the corresponding control signals S.

The data of the sensed quantities, or actions derived from them, are sent by the control unit 28 to an indicator unit 34 that can be perceived by the driver or user. The indicator unit can optically or acoustically signal to the driver, or user, which actions are performed automatically by the control unit 28 with regard to the auxiliary pump 22. In addition, states of the hydraulic arrangement 10 derived from the sensed quantities can be signalled. A degree of loading of a filter unit, for cleaning the hydraulic medium in the hydraulic tank 20, can also be derived from the sensed pump current I_p, and signalled by means of the indicator unit 34. In particular, a recommended or necessary filter change can be signalled by means of the indicator unit 28 in connection with the determined degree of loading.

A conveying channel 38, through which hydraulic medium can flow, is hydraulically interposed between the tank outlet 18 and a pump outlet 36 of the auxiliary pump 22. In FIG. 1, this conveying channel 38 is shown merely schematically, in the manner of a block diagram.

Figure 2:
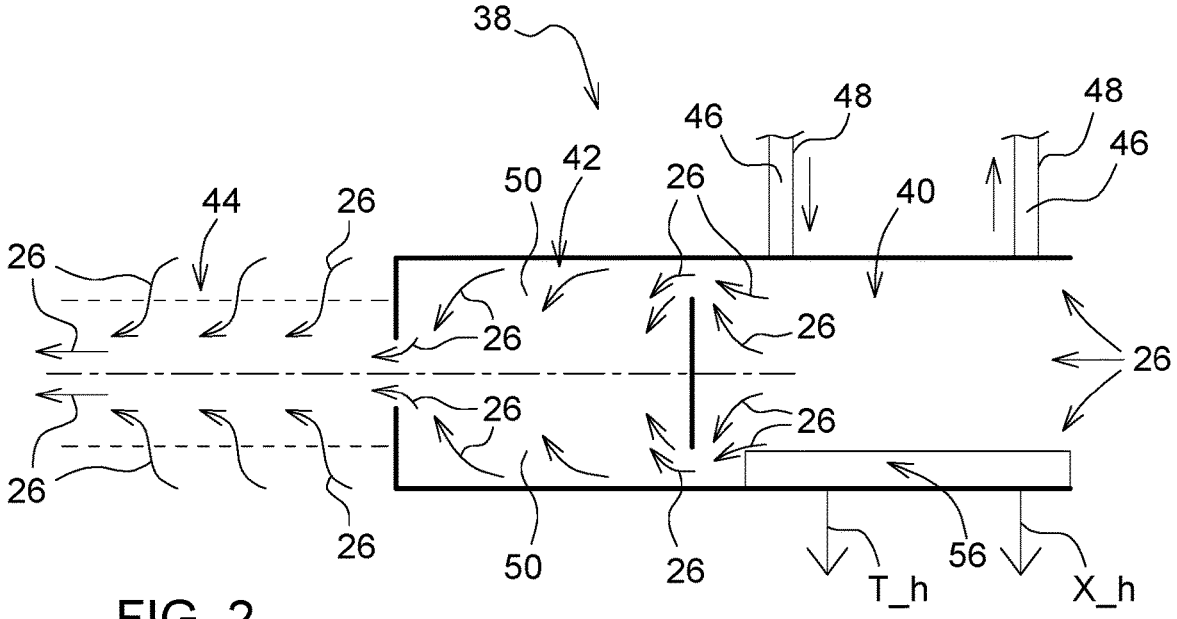
FIG. 2 is a schematic representation of an embodiment of a conveying channel within the arrangement according to FIG. 1.

FIG. 2 shows a further embodiment of the conveying channel 38. This is composed substantially of an arrangement of a plurality of components, namely a heat exchanger 40 closest to the pump outlet 36, a filter unit 42 connected to it, and a suction strainer 44 connected to the filter unit 42.

It should be noted that, irrespective of the illustration in FIG. 2, any other sequence of components 40, 42 and 44 is also conceivable.

The heat exchanger 40 has a coolant 46 flowing through it on the secondary side. Only portions of the associated cooling lines 48 are indicated here.

The filter unit 42 includes a filter element 50 having a star-shaped pleated filter material.

While the inlet of the delivery channel 38 is hydraulically connected to the pump outlet 36 of the auxiliary pump 22, an axial outlet of the suction strainer 44 is hydraulically connected to the tank outlet 18.

Fitted in the region of a return side 52 of the hydraulic arrangement 10 there is a return filter 54. This can be relatively coarsely dimensioned in respect of its filtering effect, since the existing filter unit 42 already provides a certain filtering effect. Unwanted pressure drops at the return flow filter 54 can thus be reliably avoided.

A sensor system 56 comprising, if necessary, differing specific sensors, e.g., for sensing the physical values T_h and X_h of the hydraulic medium, is arranged in the embodiment according to FIG. 2, on the conveying channel 38. The sensor system 56 sends the sensor signals to the control unit 28. In a further embodiment, not shown here, individual sensors or the entire sensor system 56 are arranged at other locations, in particular outside the conveying channel 38, or also outside the hydraulic tank 20.

For the sake of completeness, it should be pointed out that the details represented in the drawings are not necessarily to scale, and in part are shown in enlarged or reduced form to aid understanding of individual features of the hydraulic arrangement 10.

While embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A hydraulic arrangement, comprising:

a working pump for conveying a hydraulic medium in a direction of a hydraulic working load, a conveying channel through which the hydraulic medium flows, the conveying channel including a suction strainer, a hydraulic tank comprising a tank outlet hydraulically connected to an inlet side of the working pump, and an auxiliary pump mounted in the hydraulic tank, wherein, a hydraulic flow of the hydraulic medium flows in the direction of the tank outlet in dependence on a control system; and wherein the suction strainer is arranged directly before the tank outlet.

2. The arrangement according to claim 1, wherein an operation of the auxiliary pump is controllable in dependence on a sensing of at least one physical quantity of the working pump, the hydraulic medium, or the auxiliary pump.

3. The arrangement according to claim 2, wherein the operation of the auxiliary pump is operably driven by a controllable electric motor.

4. The arrangement according to claim 1, wherein the conveying channel hydraulically interposed between the tank outlet and a pump outlet of the auxiliary pump.

5. The arrangement according to claim 1, wherein the conveying channel is arranged at least partially within the hydraulic tank.

6. The arrangement according to claim 1, wherein the conveying channel comprises a heat exchanger through which the hydraulic medium flows on a secondary side.

7. The arrangement according to claim 1, wherein the conveying channel comprises a filter unit through which the hydraulic medium flows.

8. The arrangement according to claim 1, wherein the suction strainer is hydraulically connected to the tank outlet.

9. The arrangement according to claim 1, wherein the conveying channel is arranged completely within the hydraulic tank.

10. An agricultural utility vehicle, comprising:

a control unit;

at least one sensor in communication with the control unit;

a hydraulic arrangement comprising a working pump for conveying a hydraulic medium in a direction of a hydraulic working load, a hydraulic tank comprising a tank outlet hydraulically connected to an inlet side of the working pump, and an auxiliary pump mounted in the hydraulic tank; and a conveying channel through which the hydraulic medium flows, the conveying channel including a suction strainer;

wherein, the control unit operably controls a hydraulic flow of the hydraulic medium in the direction of the tank outlet; and wherein the suction strainer is arranged directly before the tank outlet.

11. The vehicle according to claim 10, wherein an operation of the auxiliary pump is controllable in dependence on a sensing by the at least one sensor of at least one physical quantity of the working pump, the hydraulic medium, or the auxiliary pump.

12. The vehicle according to 11, wherein the at least one sensor operably senses a suction pressure at the working pump, a temperature of the hydraulic medium, a coolant temperature of the vehicle, a pump current, or an ambient temperature.

13. The vehicle according to claim 11, wherein the control unit operably controls a duration of operation of the auxiliary pump based on a result of the sensing by the at least one sensor.

14. The vehicle according to claim 10, wherein the operation of the auxiliary pump is operably driven by a controllable electric motor.

15. the vehicle according to claim 10, wherein the conveying channel is hydraulically interposed between the tank outlet and a pump outlet of the auxiliary pump.

16. The vehicle according to claim 10, wherein the suction strainer is hydraulically connected to the tank outlet.

17. The vehicle according to claim 10, wherein the conveying channel is arranged completely within the hydraulic tank.

18. A hydraulic arrangement, comprising:

a working pump for conveying a hydraulic medium in a direction of a hydraulic working load, a conveying channel through which the hydraulic medium flows, a hydraulic tank comprising a tank outlet hydraulically connected to an inlet side of the working pump, and an auxiliary pump mounted in the hydraulic tank, wherein, a hydraulic flow of the hydraulic medium flows in the direction of the tank outlet in dependence on a control system; and wherein the conveying channel includes a suction strainer arranged directly before the tank outlet.

19. The hydraulic arrangement according to claim 18, wherein the operation of the auxiliary pump is operably driven by a controllable electric motor.

20. The arrangement according to claim 18, wherein the suction strainer is hydraulically connected to the tank outlet.

21. The arrangement according to claim 18, wherein the conveying channel is arranged completely within the hydraulic tank.

22. The arrangement according to claim 18, wherein the conveying channel is hydraulically interposed between the tank outlet and a pump outlet of the auxiliary pump.

* * * * *